United States Patent [19]

Steiner

[11] 4,450,952

[45] May 29, 1984

[54] FIRE GRATE FOR A COMBUSTION FURNACE

[75] Inventor: Hansruedi Steiner, Wettingen, Switzerland

[73] Assignee: Widmer & Ernst AG, Wettingen, Switzerland

[21] Appl. No.: 332,970

[22] Filed: Dec. 21, 1981

[30] Foreign Application Priority Data

Dec. 24, 1980 [DE] Fed. Rep. of Germany ..... 3049086

[51] Int. Cl.[3] ..... B65G 25/00

[52] U.S. Cl. ..... 198/773; 110/290; 110/328; 126/175

[58] Field of Search ..... 198/773, 952, 774, 775, 198/776, 777; 110/281, 282, 283, 328, 289–291; 34/164; 432/239; 126/174, 175

[56] References Cited

U.S. PATENT DOCUMENTS

| | | | |
|---|---|---|---|
| 2,806,439 | 9/1957 | Wagner | 126/175 X |
| 3,871,287 | 3/1975 | Spillman et al. | 110/328 |
| 3,980,425 | 9/1976 | Pinettes et al. | 432/239 |
| 3,985,084 | 10/1976 | Delaplace | 110/281 |
| 4,103,627 | 8/1978 | Mainka | 110/281 |
| 4,170,281 | 10/1979 | Lapeyre | 198/850 X |
| 4,239,029 | 12/1980 | Martin et al. | 110/281 X |
| 4,314,541 | 2/1982 | Martin et al. | 110/281 X |

*Primary Examiner*—Joseph E. Valenza

*Attorney, Agent, or Firm*—Bachman and LaPointe

[57] ABSTRACT

A fire grate for a combustion furnace having a pair of parallel spaced apart frame walls and a plurality of alternately arranged stationary and movable grate bars extending between and secured to the frame walls. The grate bars are formed of a plurality of grate members wherein at least two neighboring grate members are connected together by means of a removably secured clamping element.

10 Claims, 7 Drawing Figures

FIRE GRATE FOR A COMBUSTION FURNACE

BACKGROUND OF THE INVENTION

The invention concerns a fire grate for a combustion furnace, especially for the combustion of garbage with consecutive, stationary and movable series of grate bars covering a forced draught region. The grate bars are placed with their side walls parallel to each other and are at least partially connected by means of clamping elements.

With the combustion of garbage on fire grates with both movable and stationary series of grate bars, consisting of single grate bars which are also movable towards each other, arises the problem of tightness within one series of the grate bars. In case there are spaces between two grate bars, combustion material, pieces of slag or other impurities may fall in between, thus causing a fouling of the forced draught region. At the same time these interspaces allow an undesired flow away of the forced draught.

On the other hand grate bars may not be fixed too inelastically, since in case of damage even single parts must be removed fast and easily. In order to eliminate these disadvantages, e.g., a bolt which is formed at the head of a grate bar, may be inserted into a blind hole of the neighboring grate bar.

However, this does not prevent the grate bars from spreading in the direction of flow of the combustion material. There is just the possibility of exchanging them easier.

Another possibility provides the connection of all heads of the grate bars of a series by means of a bar being placed transverse to the direction of flow of the combustion material, the grate bars are laterally pressurized by a spring in order to allow thermal expansion. It is a disadvantage that for the exchange of one single grate bar element, the whole fire grate has to be put out of order. Besides, a too high lateral spring pressure could make arcuating a series of grate bars.

SUMMARY OF THE INVENTION

In view of these facts it is an object of the invention to eliminate these disadvantages and to create a grate bar clamp which is simple in design and operation and which facilitates the exchange of defective grate bars. The clamp should be form-closing but it should also allow for a thermal expansion as well as the relative motion of two grate bars towards each other. At the same time it is another object to keep down the uncontrolled flow quantity and the riddlings between two grate bars.

This object is achieved by way of the invention in that there are shoulder projections formed at the edges of the side walls of at least two neighboring grate bars towards the forced draught region being connectable with each other through a removable clamping element.

There are preferably ledge-type shoulders which are such formed to the edges that on one hand they allow a close adjoining of two neighboring side walls and on the other hand there is a distance between the side walls because of a projection formed on top of a shoulder section. Thus in a transverse view in the region of the ledge the side wall shows the shape of a foot, the side walls being adjoined with their heels. This allows to hold down the space between the two grate bars as far as possible.

The clamping element for the ledge consists of a part of a rectangular hollow section profile with a slot on one side, this slot showing a breadth which approximately corresponds with twice the width of the side wall. The hollow space itself has the same height as the projection and a breadth of approximately twice the width of the side wall plus twice the width of the projection.

The clamping element equipped like this is qualified to simply slide it over two neighboring ledges and holding them—and the corresponding grate bars—together. In case a defective grate bar has to be exchanged, the two or more connected grate bars must be lifted, the clamping element slid off the ledges, the grate bar taken out of its tie-down position, a new one set in and the clamping element newly slid over the ledges. There is extremely few time needed for this repair work.

Other shapes of ledges and, therefore, of clamping parts, like e.g. a dovetail, semicircular, are also possible.

Besides, the clamping element holds the grate bars closely together and according to the invention the ledges are formed at sections of favorable clamping effect, i.e. approximately in the middle of the bottom part of the grate bar. An intrustion of combustion material or slag parts into the interspaces is very seldom; there is no undesired flow away of the forced draught.

Normally it is sufficient to keep the two lateral parts respectively the leg portions in a distance to each other, so that there remains a form-locking with the ledges even with a thermal expansion of the material of the grate bar.

The invention also comprises resilient clamping members arranged on the leg portions in the interior of the clamping elements. The clamping members bring about the same form locking both with cold and hot grate bars. Preferrably these are restorable pressure or flat springs or even pressure rolls fixed against the return power of a power accumulator, the latter facilitating the clutching element to slide over the ledges.

It is also within the scope of the invention, that the clamping element is secured against displacement by a simple stop which is fixed at least at one end of the clamping element. If both front sides of the clamping element shall be provided with stops, one of them has to be removable.

However, in order to allow a relative motion between two connected grate bars, without enabling the clamping element to spring off the ledges at the same time, the clamping element is according to the invention secured against displacement on at least one side wall respectively projection. This may be done by a bolt gripping from the outside part of the clamping element into a blind hole of the projection. For the reason of better operation, the bolt may be also removed from the blind hole against the return power of a power accumulator by means of a rocker arm.

Other similar technical aid is also within the scope of the invention.

If such a bolt mechanism is provided for at both neighboring projections, usually of the two corresponding blind holes is equipped as oblong hole in order to allow a motion between the two grate bars.

Another advantage of this clamp is its simple and inexpensive manufacture, granting a high flexibility during operation.

BRIEF DESCRIPTION OF THE FIGURES OF THE DRAWING

Further advantages, features, and details of the invention will become evident from the following description of preferred embodiments given with reference to the drawings, in which.

DETAILED DESCRIPTION

Figure 1:
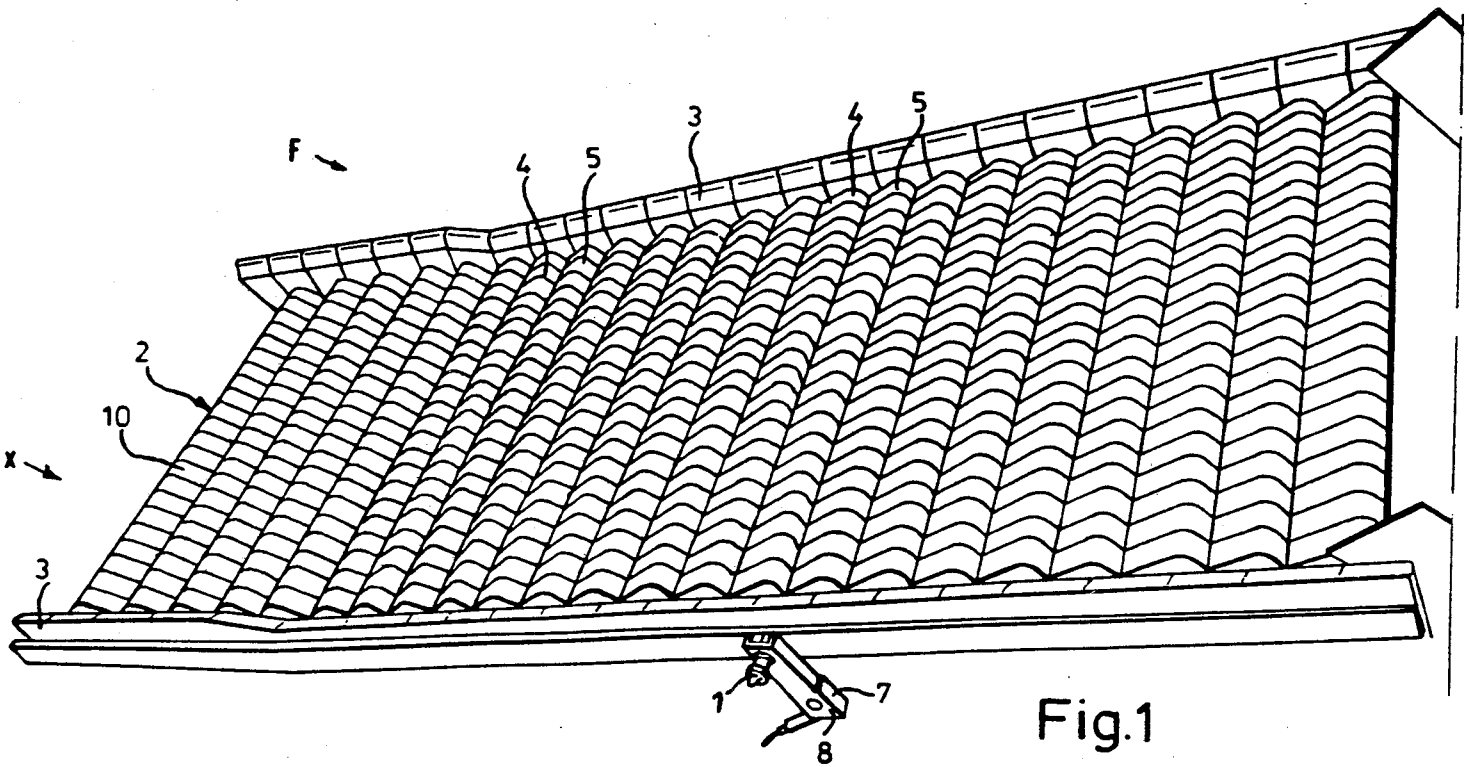
FIG. 1 is a perspective view of a mainly schematic representation of a fire grate.

According to FIG. 1 a fire grate F comprises series of grate bars 2 which are arranged step-wise, roof-tile-type overlapped by each other and limited by side walls 3.

With the series of grate bars 2 each one stationary series of grate bars 4 is alternating in the direction of flow x of a combustion material, which is not shown, with one movable series of grate bars 5 in the direction of flow x.

Each of the movable series of grate bars 5 is connected with the shaft 1 by means of arms; the shaft penetrates the side wall 3 and is connected with a drive 8 through a compound lever arrangement 7. As an example, there is only shown one drive 8 with the corresponding lever arrangement 7 and the shaft 1 in FIG. 1.

The forced draught region is limited towards the top by the series of grate bars 4 and 5, and laterally by the side walls 3.

Figure 2:
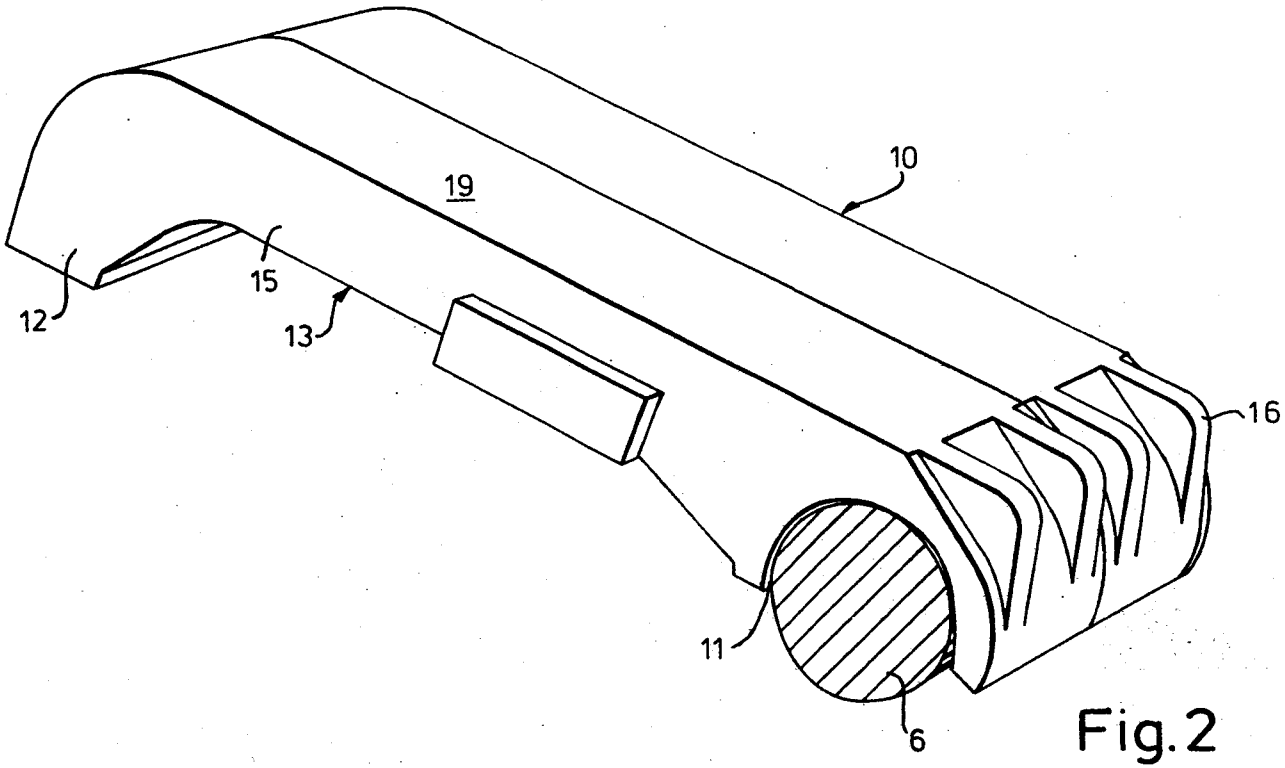
FIG. 2 is a perspective view of the top side of two grate bars.
Figure 3:
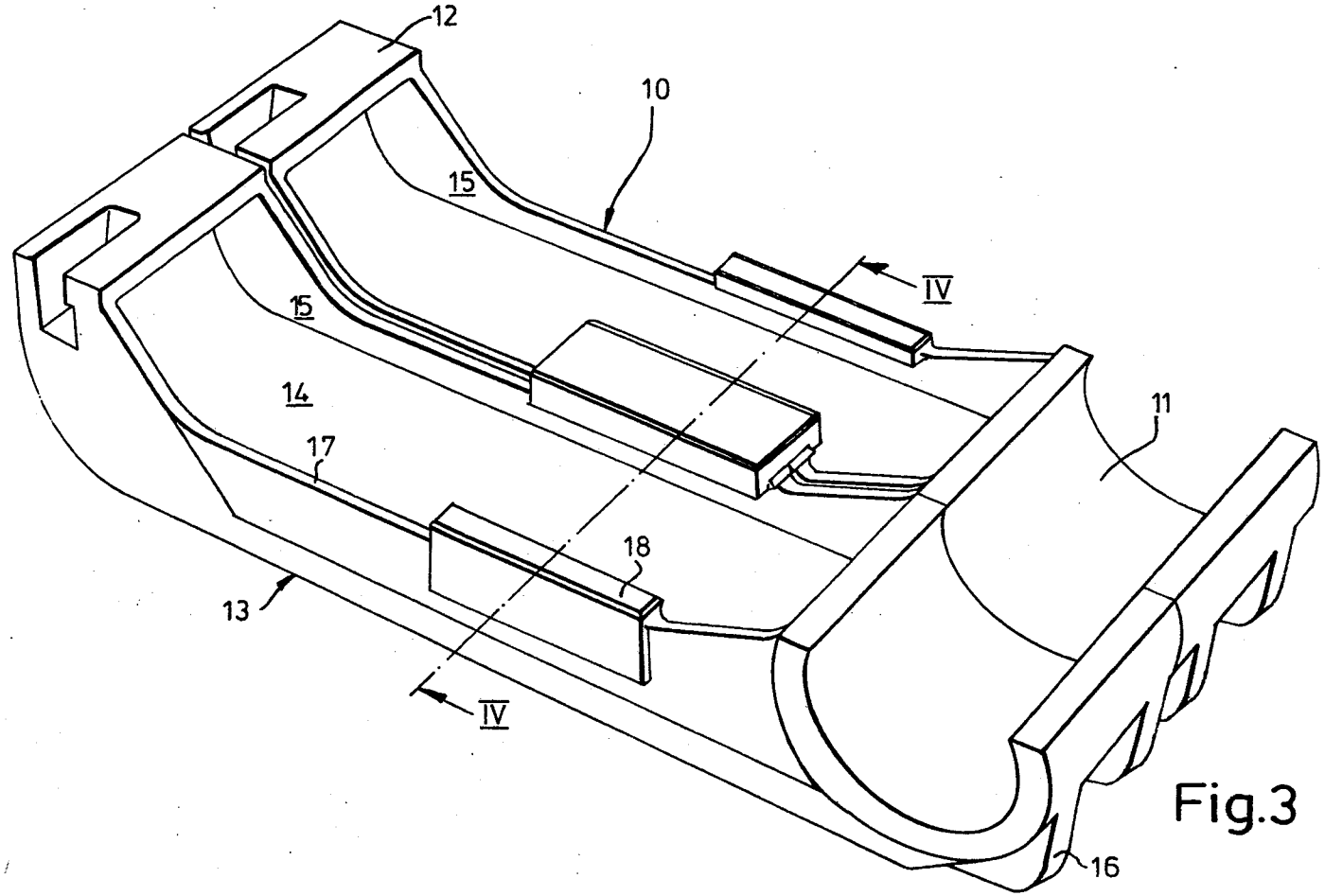
FIG. 3 is a perspective view of the bottom side of two grate bars.

Both the stationary and the movable series of grate bars 4, 5 comprise a multitude of individual grate members 10 with a claw-type shape according to FIGS. 2 and 3. At one end, for example, the grate members 10 of the movable series of grate bars 5 are vertically hinged to the grate bar support 6 by means of a semi-cylindrical recess 11, at the other end they are provided with a claw-cone 12 on the grate members 10 of the series of grate bars 4 which follow in the direction of flow x. Between recess 11 and claw-cone 12 there is a box-type middle part 13 with a cover 14 and two side walls 15.

Close to the recess 11 the grate bar ends are provided with flanges 16.

Figure 4:
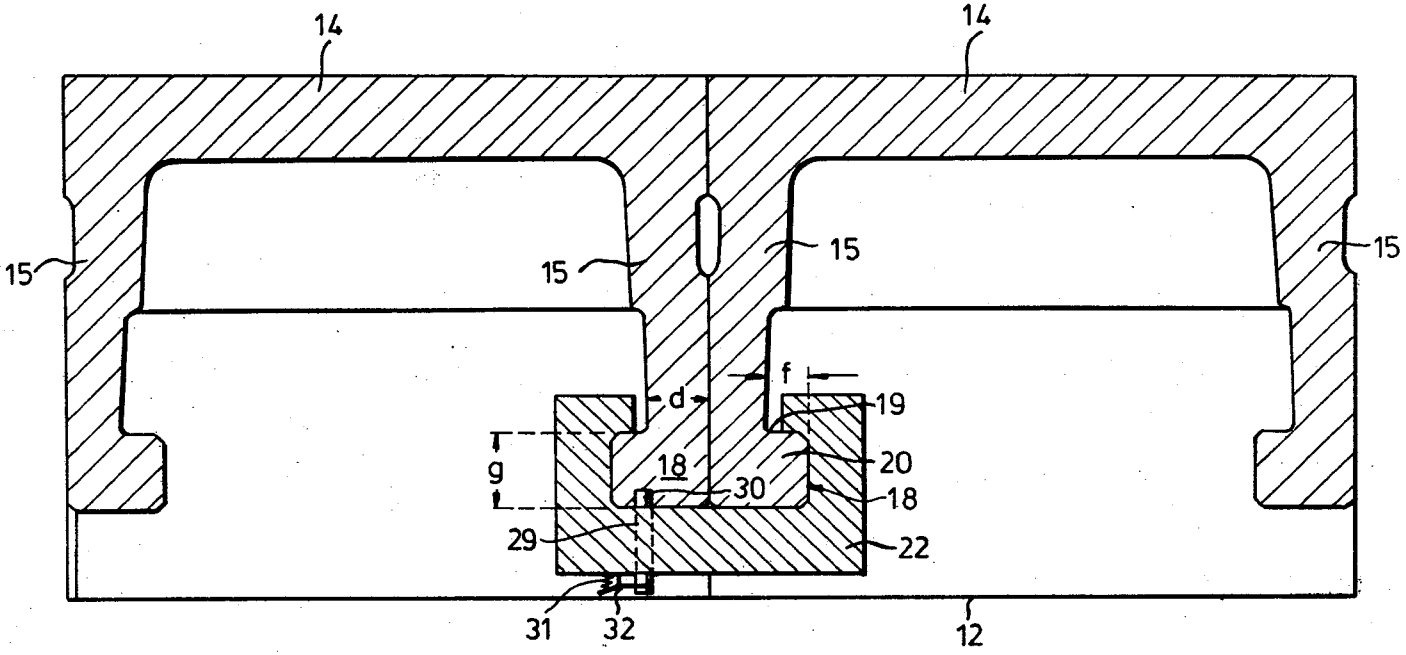
FIG. 4 is a cross sectional view through two grate bars along the line IV—IV in FIG. 3.

The side walls 15 carry some ledges 18 which are formed on their rib 17 turned to the forced draught region. The ledges 18 are preferrably equipped as in FIG. 4, so that they allow the adjoining of the outside of side walls 15 of two neighboring grate members 10 on one hand, and on the other hand they have on the inside of the side walls 15 a projection 20 which is formed by a shoulder section 19. There are other possibilities too of forming the shoulder section 20 dovetail-type or semicircular.

Two grate members 10 are held together in closed position by a U-shaped clamping element 22 over the projections 20.

Figure 5:
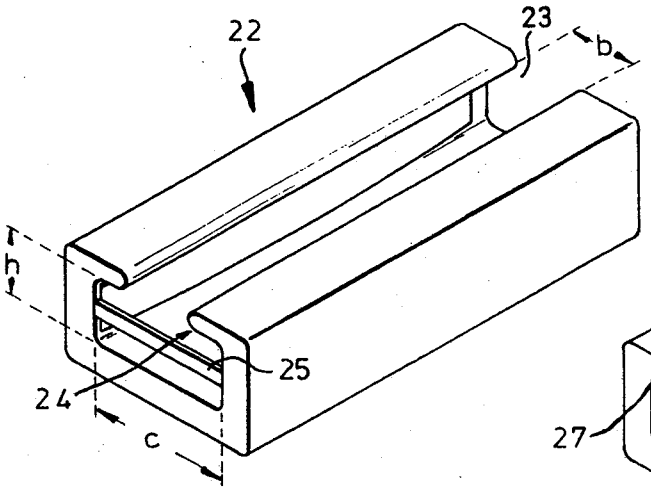
FIG. 5 is a perspective view of a clamping element.
Figure 7:
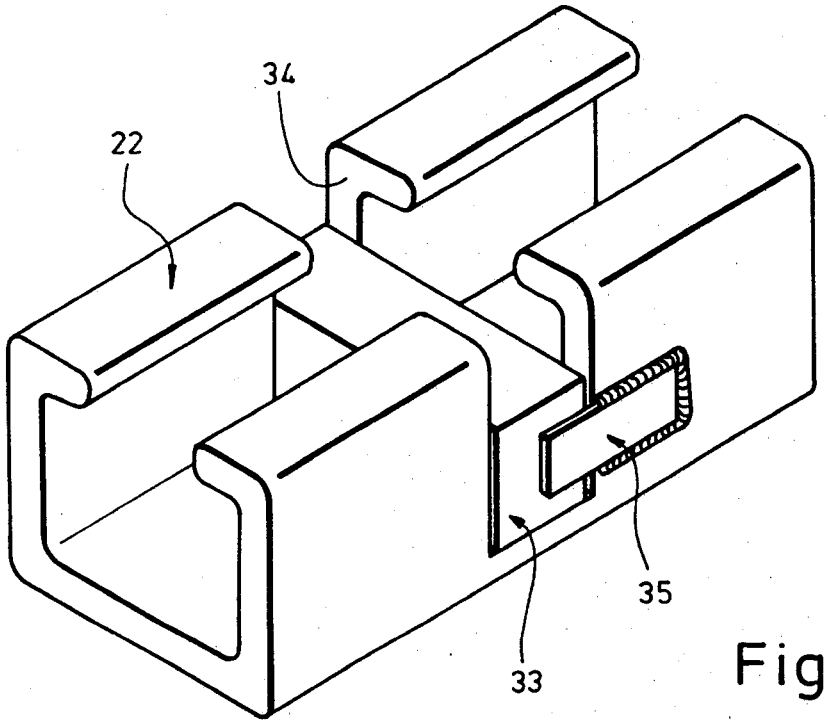
FIG. 7 is a perspective view of a clamping element with fuse element.

According to FIG. 5, the U-shaped clamping element 22 consists of a part of a box-type hollow section profile having a base portion and a pair of parallel leg portions 27 having opposed flanges defining a slot 23 with a breadth b of approximately twice the width of the wall d of the side wall 15.

The approximately rectangular space 24 of the U-shaped clamping element 22 has a height h which corresponds to the height g of the projection 20, and a breadth c which is a little larger than twice the width of the wall plus twice the size f of the projection 20.

This shape enables one to slide two neighboring ledges 18 of two side walls 15 into the hollow space 24, the slide-in depth being limited by a simple stop 25.

Figure 6:
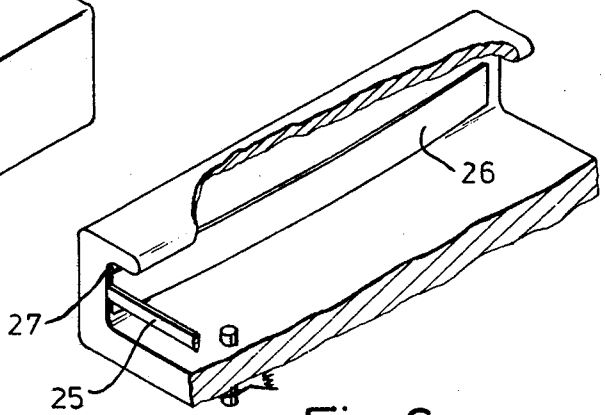
FIG. 6 is a perspective view of a partially cut clamping element with pressure spring.

In addition, for better holding of the clamping element 22 a pressure spring 26 according to FIG. 6 is provided on at least one leg portion 27 in the hollow space.

The relative motion that exists during operation between two neighboring grate members 10 of the movable series of grate bars 5, could cause an undesired loosening of the clamping element. Therefore, in order to secure the clamping element, there is provided a bolt 29 which inserts into the hollow space 24 at a grate member 10, for example, and reaches into a blind hole 30 of the ledge 18. The bolt 29 may be removed from the blind hole 30 by means of a rocker arm 32 which can be turned against the power accumulator 31, in order to reloosen the clamping element.

Another security measure for the clamping element ensues by a wedge 33 which is inserted into the cut 34 and held by a sheet 35 at both sides. When using this security measure, the shoulder sections 19 and the adapted ledges 18 are also cut in. The breadth of the cut 34 allows a relative motion of two neighboring grate bars.

Both the pressure springs 26 and the bolts 29 with the rocker arm arrangement 32, 31 are just examples, therefore, according to the invention, they may be replaced by other well-known means (e.g. impression rollers, locking-bolts, stops, wedges).

It is to be understood that the invention is not limited to the illustrations described and shown herein, which are deemed to be merely illustrative of the best modes of carrying out the invention, and wich are susceptible of modification of form, size, arrangement of parts and details of operation. The invention rather is intended to encompass all such modifications which are within its spirit and scope as defined by the claims.

What I claim is:

1. A fire grate for conveying a material to be burned in a combustion furnace comprising a pair of parallel spaced apart frame walls, a plurality of alternately arranged series of stationary and movable grate bars extending between and secured to said frame walls, said grate bars being formed of a plurality of grate members each having a top portion, a pair of side walls and a rib extending from each of said side walls wherein the ribs extending from the side walls of each of said plurality of grate members are being provided with inwardly extending opposed projections wherein at least two neighboring abutting grate members of said plurality of grate members are connected together by means of a clamping element removably secured to the inwardly extending projections on the ribs of the abutting side walls of said neighboring grate members.

2. A fire grate according to claim 1 wherein said clamping element comprises a substantially U-shaped channel having a base portion, a pair of parallel leg portions extending upwardly from said base portion and substantially perpendicular thereto, said leg portions each being provided with an opposing flange at the top thereof defining a slot the width of which is approximately equal to twice the width of the side wall of a grate member.

3. A fire grate according to claim 2 wherein the distance h between the top surface of said base portion and the under surface of the opposing flanges is substantially equal to the thickness of the inwardly extending projections on said ribs of said abutting side walls.

4. A fire grate according to claim 3 wherein the distance between the inner surfaces of said upwardly extending parallel leg portions is equal to approximately twice the width of a side wall plus twice the width of a projection.

5. A fire grate according to claim 2 wherein the inside surfaces of said upwardly extending leg portions are provided with resilient clamping members.

6. A fire grate according to claim 5 wherein said resilient clamping members are in the form of springs.

7. A fire grate according to claim 1 wherein said clamping element is secured to one of said inwardly extending projections by means of a pin.

8. A fire grate according to claim 7 wherein said pin is inserted into a blind hole in said one of said inwardly extending projections.

9. A fire grate according to claim 1 wherein said clamping element is provided with a stop for limiting the position of said clamping element on said inwardly extending projections.

10. A fire grate according to claim 1 wherein said clamping element is secured to said inwardly extending projections by means of a wedge.

* * * * *